United States Patent [19]

Cooch

[11] Patent Number: 4,994,948

[45] Date of Patent: Feb. 19, 1991

[54] CONCAVE LIGHT REFLECTOR

[75] Inventor: Stephen L. Cooch, Big Flats, N.Y.

[73] Assignee: Corning Incorporated, Corning, N.Y.

[21] Appl. No.: 509,132

[22] Filed: Apr. 16, 1990

[51] Int. Cl.[5] ..... F21V 7/00

[52] U.S. Cl. ..... 362/346; 362/348; 362/297

[58] Field of Search ..... 362/346, 347, 348, 350, 362/297

[56] References Cited

U.S. PATENT DOCUMENTS

| | | | |
|---|---|---|---|
| 4,021,659 | 5/1977 | Wiley | 362/297 |
| 4,545,000 | 10/1985 | Fraley et al. | 362/348 |
| 4,789,923 | 12/1988 | Sales | 362/346 |
| 4,905,133 | 2/1990 | Mayer et al. | 362/350 |

*Primary Examiner*—Carroll B. Dority

*Attorney, Agent, or Firm*—Milton M. Peterson; Richard N. Wardell

[57] ABSTRACT

A bowl-shaped, concave reflector, adapted to be assembled with a lamp to provide light reflection, is disclosed. The reflector has a large, front opening through which light is projected, and which is bordered by a peripheral rim composed of four corner zones and four side zones alternating therewith. The width of the rim in the corner zones is greater than that in the intermediate side zones, and the wall of the reflector has four flattened zones adjacent the side zones of the rim, whereby the reflector has the exterior appearance of a four sided body.

8 Claims, 3 Drawing Sheets

CONCAVE LIGHT REFLECTOR

FIELD OF THE INVENTION

The field is light reflectors adapted to use in a lamp assembly to project a beam or pattern of light.

INTRODUCTION

The invention is concerned with a concave, bowl-shaped body having an internal, light reflecting surface. The reflector may be assembled with an electric lamp in any general purpose lighting assembly to project a beam or pattern of light. However, it has particular utility in spotlighting or display lighting for either home or commercial use.

The reflector has a large, open end through which a beam or pattern of light from a lamp is projected. In a lamp assembly, this end may remain open, or may be closed with a lens or panel. Opposite this large, open end is a relatively small opening within which a light source and electric lead wires may be mounted. This small end may simply be an opening, or may be a perforated extension protruding from the bowl.

Such lamp assemblies, and particularly the reflector members, are well known and widely used. Customarily, the reflector has been a pressed, concave body, usually glass. It has been circular, and generally of uniform wall thickness, at any selected wall height.

Traditionally, the internal, light reflecting surface was a smooth, unbroken surface. While that is still viable, some type of multi-faceted, reflecting surface is now more commonly used. A popular version is illustrated in U.S. Pat. No. 4,021,659 (Wiley). The reflecting surface shown in that patent is ellipsoidal in nature, and is composed of a plurality of radial bands and a plurality of concentric, circular bands. This provides a multi-faceted surface which spreads the reflected light into a larger and smoother pattern.

PURPOSES OF THE INVENTION

Recently, it has become desirable to provide a reflector having an external appearance that is square, rather than round. At the same time, it would be desirable to avoid disturbing the nature of the internal reflecting surface. Such a modified reflector is of particular interest for design purposes in halogen lamp assemblies used for spotlights and the like.

Accordingly, a basic purpose is to provide a light reflector member having a square external appearance.

Another purpose is to create such an appearance with a minimal effect on the light pattern reflected by the internal surface.

A further purpose is to provide a reflector bowl having a standard interior surface, and a modified external surface having a square appearance.

SUMMARY OF THE INVENTION

The reflector of my invention is a bowl-shaped, concave body for assembly with a lamp to provide light reflection, wherein the reflector has an interior surface that converges from a large front opening to a small rear opening that is adapted to receive a lamp base, the large front opening being bordered by a peripheral rim composed of four corner zones, and four side zones alternating therewith, the width of the rim in the four corner zones being greater than that of the intermediate side zones, and the wall of the reflector having four flattened zones, each having a generally curved periphery and being adjacent a side zone of the rim, whereby the reflector has the external appearance of a four-sided body.

In a preferred embodiment, the interior surface of the reflector is ellipsoidal in nature, and is composed of a plurality of radial bands and a plurality of concentric, circular bands to provide a multi-faceted surface for spreading the reflected light into a large, smooth pattern, and wherein the radial bands converge from the large front opening to the small rear opening. In another embodiment, the wall of the reflector is composed of corner zones and side zones corresponding to those of the rim, and the maximum wall thickness in the corner zones is greater than that in the side zones. In still another embodiment, the rim of the large open end of the reflector has an inner portion that is sunken. This provides a seat for a panel to be mounted to close the opening.

PRIOR ART

U.S. Pat. No. 4,021,659 (Wiley) describes a projector lamp reflector in which the concave reflecting surface is composed of a plurality of radial bands and a plurality of concentric, circular bands to provide a multi-faceted surface for spreading the reflected light into a larger and smoother pattern and reducing the amount of imaging of lamp components in the light pattern. U.S. Pat. No. 4,785,383 (Tarnay) describes a glass reflector unit having a hollow cavity portion projecting from the rear side that has grooves and/or depressions molded on exterior surfaces to engage mounting means.

The Tarnay and Wiley reflectors both have a conventional round appearance.

U.S. Pat. No. 2,662,347 (Giffen) describes a mold for forming a rectangular television tube funnel by centrifugal action on a gob of glass.

U.S. Pat. No. 2,764,810 (Gardiner) describes a method for making a metal funnel portion for a rectangularized television tube. Neither Giffen nor Gardiner provide a circular interior on their funnels.

GENERAL DESCRIPTION OF THE INVENTION

Figure 1:
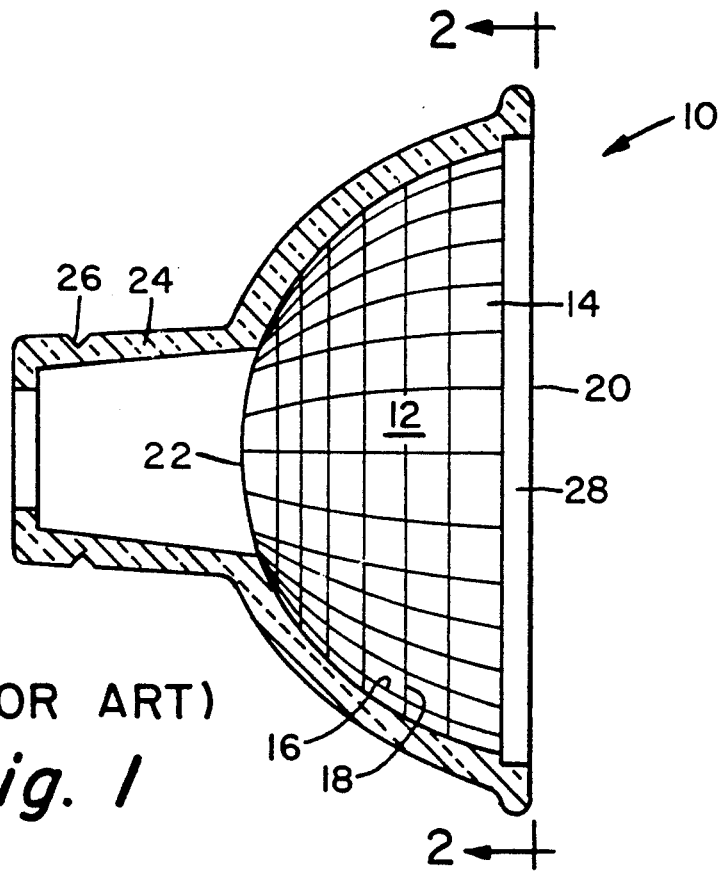
(PRIOR ART) Fig. 1
FIG. 1 is a side sectional view of a conventional prior art reflector.

FIG. 1 shows a side sectional view of a conventional, round reflector 10. The inner surface 12 of reflector 10 is shown with a multi-faceted pattern such as described in detail in U.S. Pat. No. 4,021,659 (Wiley). Facets 14 result from radial bands 16 intersecting concentric, circular bands 18.

Multi-faceted surface 12 is generally preferred, since it tends to spread light reflected from the surface into a large, smooth pattern. However, it will be understood that surface 12 may also be a smooth, unbroken surface, or it may employ other multi-faceted patterns. Inasmuch as the present invention is not concerned with the nature of reflecting surface 12, it may be employed with any reflecting pattern.

Radial bands 16 converge from a large front opening 20, through which light is projected, to a small rear opening 22. The latter opens into a perforated extension 24 within which a lamp (not shown) may be mounted, and through which electric leads may enter and be secured. Extension 24 may have grooves and/or indentations 26 formed along opposite external sides. These accommodate auxiliary support means for the lamp assembly, for example, spring biased, metal prongs.

Figure 2:
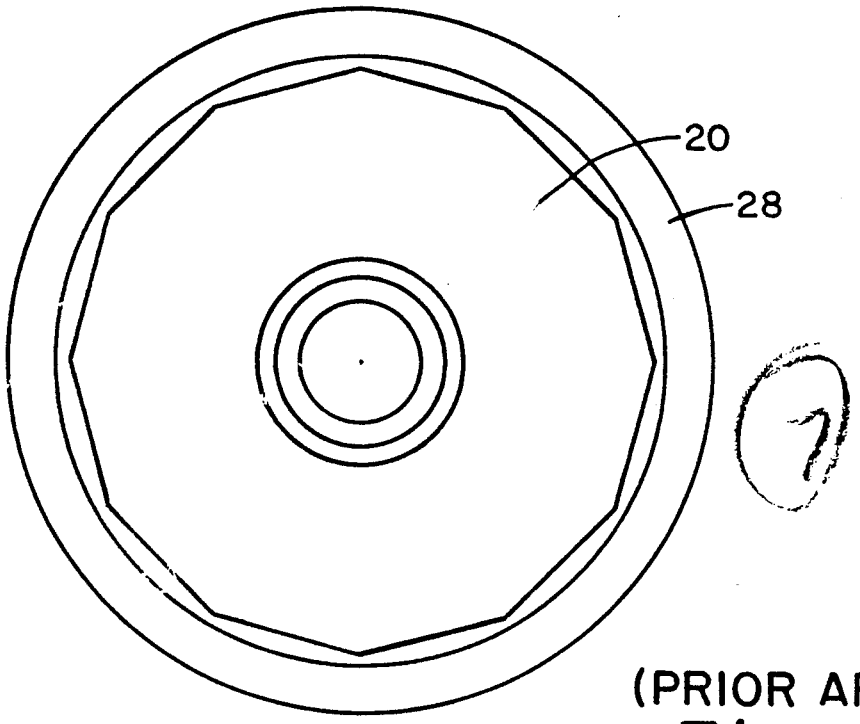
(PRIOR ART) Fig. 2
FIG. 2 is a view of the reflector rim configuration taken on line 2—2 of FIG. 1.

FIG. 2 is a view along line 2—2 showing the configuration of rim 28 of reflector 10. It depicts the generally circular appearance, and the uniform wall thickness and contour characteristics, of prior commercial reflector rims.

Figure 3:
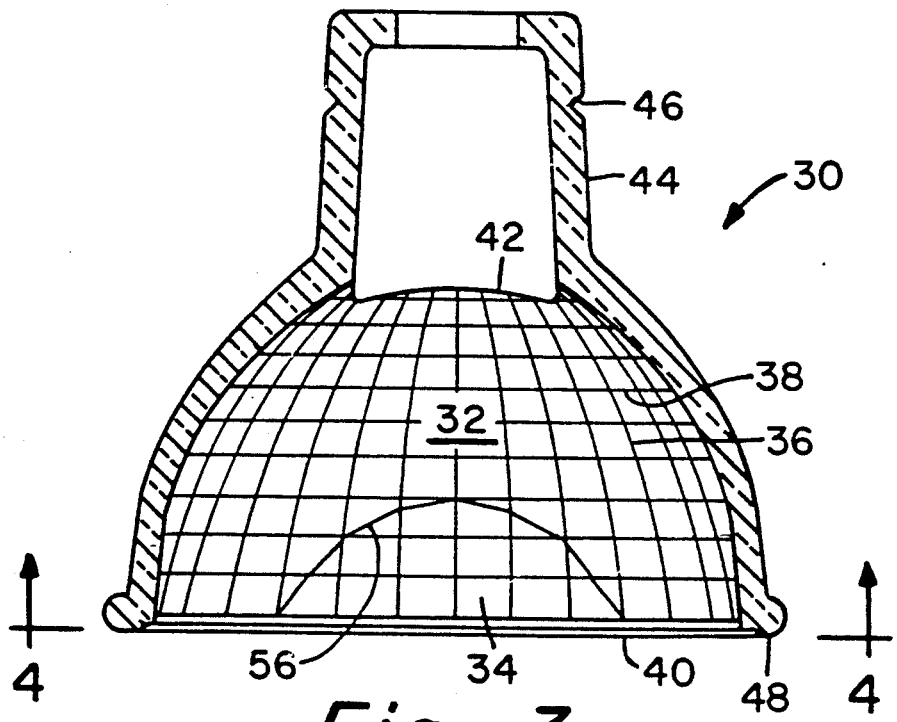
FIG. 3 is a side sectional view of a reflector in accordance with the present invention.

FIG. 3 is a side sectional view of a reflector 30 shaped in accordance with the present invention. In accordance with conventional practice, internal surface 32 may be either a smooth unbroken surface, or may be a multi-faceted surface as shown in FIG. 1. It is here shown in the preferred, multi-faceted form. As in FIG. 1, surface 32 is composed of individual facets 34 resulting from radial bands 36 intersecting concentric, circular bands 38.

Also, as in FIG. 1, radial bands 36 converge from a large, front opening 40 to a small, rear opening 42. Opening 42 merges into a perforated extension 44. Extension 44 is designed to receive an electric lamp. For this purpose, its interior walls will be tapered to facilitate lamp mounting. Likewise, electric leads may be introduced through the outer end of extension 44 in conventional manner. The exterior walls may have horizontal grooves and/or indentations 46 provided to receive supporting members for the lamp assembly.

Figure 4:
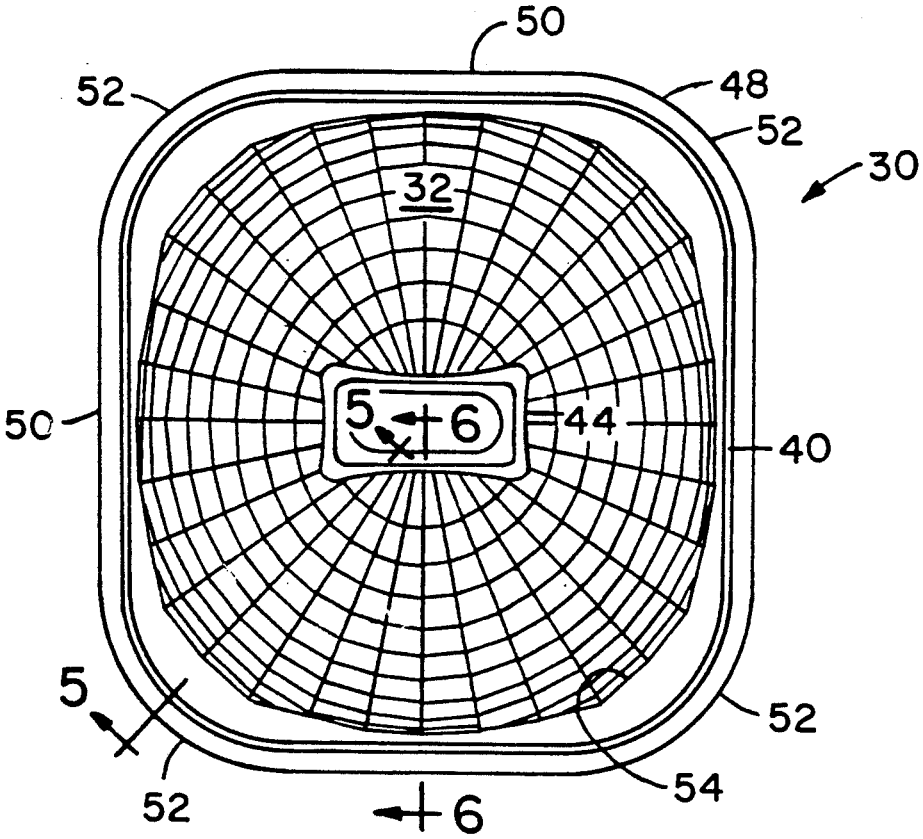
FIG. 4 is a view of the reflector rim configuration taken on line 4—4 of FIG. 3.

The appearance of reflector 30 becomes more apparent from FIG. 4. This FIGURE is a view along line 4—4 showing the configuration of rim 48 which surrounds opening 40 of reflector 30. Side zones 50 of rim 48 are relatively narrow, and become continuously wider as the centers of corner zones 52 are approached. This imparts a generally square appearance to rim 48, particularly when viewed through opening 40.

Inner edge 54 of rim 48 also constitutes the lower edge of reflecting surface 32. It has essentially the circular form of conventional reflector 10 of FIG. 1. To achieve an essentially straight side, as shown, it is necessary to flatten side zones 50 of rim 48, and adjacent zones 56 of the reflector sidewall. However, this tends to diminish mechanical strength in these areas. Therefore, to avoid unduly thinning the flattened zones, a corresponding zone may be built up, as shown on the inside surface. Zone 56, and more particularly its built-up counterpart, are kept small to minimize the effect on quality of the projected light pattern. Preferably, the maximum height of zone 56 extends no more than a third of the distance up the reflector wall.

Figure 5:
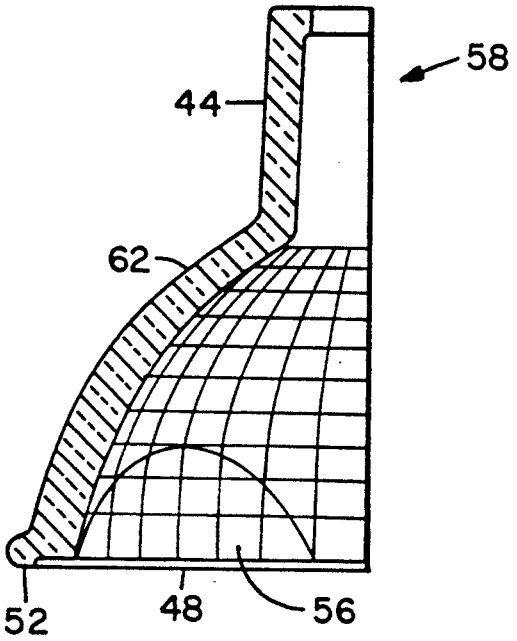
FIG. 5 is a side sectional view of a reflector segment showing a modified form of the invention.
Figure 6:
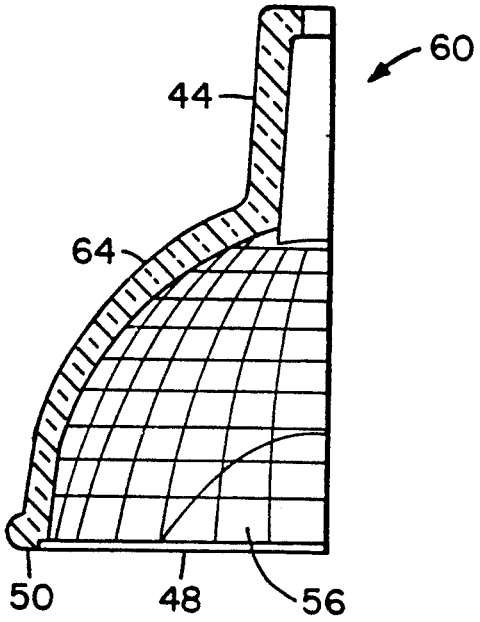
FIG. 6 is a side sectional view of another segment of the reflector of FIG. 5, further illustrating the modification.

FIGS. 5 and 6 are side sectional views of reflector segments 58 and 60 taken from a modified version of the inventive reflector. In this modified version, the reflector wall has four corner zones 62 and, intermediate thereof, four side zones 64. The wall corner zones 62 extend from corner zones 52 of rim 48 to the rear projection 44 shown in FIG. 3. Likewise, side zones 64 extend from side zones 50 of rim 48 to projection 44.

Purely for location purposes, the position of segments 58 and 60 in the modified version are shown as lines 5—5 and 6—6, respectively, in FIG. 4. Segment 58 of FIG. 5, then, is taken from a corner of the modified reflector.

Each corner zone 62 is characterized by a wall thickness greater than that of side zones 64 which are shown in FIG. 6. The greater wall thickness is achieved by altering the contour of the outer surface. The internal light reflecting surface remains unaltered, thereby fully retaining its function of light reflection. The build-up in thickness is progressive from each side zone 64 to the center of the corner zone 62.

FIG. 6 is a side section view of a segment taken along a line rotated 45 degrees from the corner section of FIG. 5. The side section shown in FIG. 6 is through the center of flattened zone 56 in the sidewall of the modified reflector. The wall thickness in this section is the same as in the unmodified version shown in FIG. 3. In a typical projection lamp reflector, for example, zone 56 may have a wall thickness of about 0.064", sidewall zone 64, above zone 56, may be in the range of 0.070" to 0.090", and corner zone 62 may have a maximum wall thickness of about 0.133".

Figure 7:
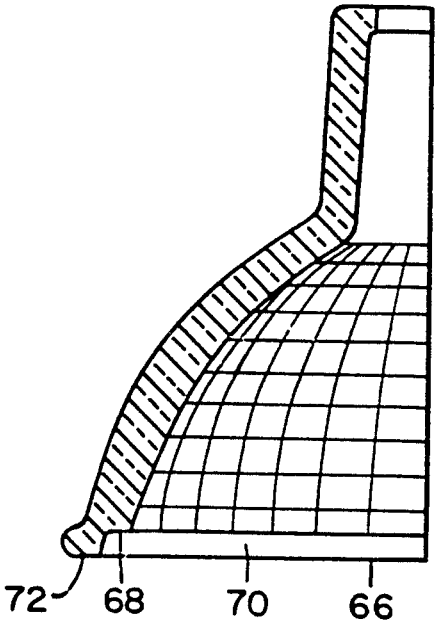
FIG. 7 is a side sectional view of a reflector segment showing a further modification of the invention.

Reflector 30 may remain open, or may have a lens or panel sealed to rim 48. FIG. 7 is a side sectional view corresponding to that of FIG. 6, except for the construction of rim 66. Thus, rim 66 has a sunken inner section 68 which provides a seat 70 adapted to receive a panel member (not shown). Seat 70 may be of such depth that a panel member, seated therein, has its outer surface flush with outer edge 72 of rim 48.

I claim:

1. In a bowl-shaped, concave reflector, for assembly with a lamp to provide light reflection, wherein the reflector has an inner surface that converges from a large, front opening to a small, rear opening adapted to receive a lamp base, the large, front opening being bordered by a peripheral rim composed of four corner zones and four side zones alternating therewith, the width of the rim in the four corner zones being greater than that of the intermediate side zones and the wall of the reflector having four flattened zones that are adjacent the four side zones of the rim, whereby the reflector has the exterior appearance of a four sided body.

2. A reflector in accordance with claim 1 wherein the inner surface is ellipsoidal in nature.

3. A reflector in accordance with claim 1 wherein the inner surface is composed of a plurality of radial bands and a plurality of concentric circular bands to provide a multi-faceted surface for spreading the light into a larger and smoother pattern.

4. A reflector in accordance with claim 1 wherein the wall of the reflector is composed of corner zones and side zones corresponding to those of the rim, and the maximum wall thickness in the corner zones is greater than that in the side zones.

5. A reflector in accordance with claim 4 wherein the maximum wall thickness in the corner zones is about twice that in the flattened zones in the side zones of the wall.

6. A reflector in accordance with claim 1 wherein the rim at the large open end of the reflector has a sunken portion in the nature of a seat within which a panel may be mounted.

7. A reflector in accordance with claim 1 wherein the small, rear opening of the reflector has a perforated extension within which a lamp might be mounted.

8. A reflector in accordance with claim 7 wherein opposed, exterior surfaces of the perforated extension have horizontal grooves formed therein to receive support members.

* * * * *